US007357240B2

(12) United States Patent
Ogimura et al.

(10) Patent No.: US 7,357,240 B2
(45) Date of Patent: Apr. 15, 2008

(54) CONVEYOR APPARATUS

(75) Inventors: Yoshio Ogimura, Himeji (JP); Takayuki Kikuchi, Himeji (JP); Yasuhiro Matsumoto, Fuchu (JP); Yoshinobu Ishikawa, Fuchu (JP); Shin Murakami, Fuchu (JP)

(73) Assignee: Toshiba Elevator Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/474,464

(22) Filed: Jun. 26, 2006

(65) Prior Publication Data

US 2006/0237283 A1 Oct. 26, 2006

Related U.S. Application Data

(63) Continuation of application No. PCT/JP2004/019748, filed on Dec. 24, 2004.

(30) Foreign Application Priority Data

Dec. 26, 2003 (JP) ..... 2003-434511

(51) Int. Cl.
*B65B 21/02* (2006.01)

(52) U.S. Cl. ..... 198/330

(58) Field of Classification Search ..... 198/330
See application file for complete search history.

(56) References Cited

U.S. PATENT DOCUMENTS 3,677,388 A * 7/1972 Boltrek et al. ..... 198/833
4,944,713 A * 7/1990 Salerno ..... 474/11
5,348,131 A * 9/1994 Yamaguchi et al. ..... 198/330
6,971,497 B2 * 12/2005 Illedits et al. ..... 198/330
2002/0104735 A1 8/2002 Ostermeier et al.
2002/0175040 A1 11/2002 Postlmayr
2002/0179404 A1 12/2002 Ishikawa et al.

FOREIGN PATENT DOCUMENTS

EP 0138372 A1 4/1985
JP 2002-128441 A 5/2002
JP 2003-192263 A 7/2003

* cited by examiner

*Primary Examiner*—Mark A. Deuble
(74) *Attorney, Agent, or Firm*—Foley & Lardner LLP

(57) ABSTRACT

A conveyor apparatus comprises step chains which couple a plurality of steps such that the steps, and driving units which drive the chains. Each of the driving units comprises a power unit comprising a motor, and a driving machine including pulleys and belts that reduce a rotation speed of the motor so as to meet a required reduction gear ratio and transfer the rotation speed to the chains, and a pair of right and left driving mechanisms that convert a rotary movement transferred from the machine of the power unit via an eccentric shaft into a movement of rocking units, and apply a propelling force to the chains via pin rollers provided at any one of sides of the rocking units and the chains and gears provided at the other side of the rocking units and the chains to engage with the rollers.

3 Claims, 9 Drawing Sheets

CONVEYOR APPARATUS

CROSS REFERENCE TO RELATED APPLICATIONS

This is a Continuation Application of PCT Application No. PCT/JP2004/019748, filed Dec. 24, 2004, which was published under PCT Article 21(2) in English.

This application is based upon and claims the benefit of priority from prior Japanese Patent Application No. 2003-434511, filed Dec. 26, 2003, the entire contents of which are incorporated herein by reference.

BACKGROUND OF THE INVENTION

1. Field of the Invention

This invention relates to a conveyor apparatus suitable for an escalator of a great height of story, a passenger-carrying conveyor of a great moving distance, or the like.

2. Description of the Related Art

Several structures of a conveyor apparatus capable of driving an escalator of a great height of story, a passenger-carrying conveyor of a great moving distance, or the like, by using a cheap standard chain, have been proposed.

FIG. 6 shows an example of a structure of a conventional conveyor apparatus.

The conveyor apparatus shown in FIG. 6 is an escalator. The escalator comprises a structure 1, a track 2, steps 3, chains 4 and three dispersed driving units 10*a*, 10*b* and 10*c*.

The track 2 is provided to circulate around the structure 1. A plurality of steps 3 are moved along the track 2. The chains 4 are a pair of chains (at the front side and the back side of the figure) having pin rollers 4*a* which couple a plurality of steps 3 such that the steps circulate endlessly.

Three driving units 10*a*, 10*b* and 10*c* comprise rocking units 32, respectively. The rocking units 32 supply a propelling force to the chains 4. This technique is disclosed in, for example, Jpn. Pat. Appln. KOKAI Publication No. 2002-128441.

Since the driving units 10*a*, 10*b* and 10*c* have the same structure, the driving unit 10*a* alone is explained below as their typical example.

FIG. 7 shows a detailed structure of the driving unit 10*a*.

The driving unit 10*a* comprises a power unit 20 which generates power, and chain driving mechanisms 30 which are arranged in pairs at right and left sides to sandwich the power unit 20. The power unit 20 has a motor 21 and a driving machine 22 which are attached to the structure 1.

The chain driving mechanisms 30 comprise eccentric shafts 31, the rocking units 32, trochoid-shaped rolling gears (hereinafter called trochoidal rolling gears) 33, and backside guide plates 34. The eccentric shafts 31 input rotation of the power unit 20. The rocking units 32 convert the rotation of the eccentric shafts 31 into rocking movement. The trochoidal rolling gears 33 engage with the pin rollers 4*a* which are attached to the chains 4 at regular intervals so as to be freely rotatable and supply the rocking movement of the rocking units 32 to the chains 4 as the propelling force.

The pin rollers 4*a* may be attached to the chains 4 at regular intervals or attached to the rocking units 32. The backside guide plates 34 guide the pin rollers 4*a*.

Therefore, in the driving unit 10*a* having the above-described structure, if the rotary speed of the motor of the power unit 20 is made lower by the driving machine 22 to drive the eccentric shafts 31, the propelling force is supplied from the rocking units 32 to the chains 4 via the trochoidal rolling gears 33 engaging with the pin rollers 4*a* attached to the chains 4, and the steps 3 coupled to the chins 4 to circulate endlessly can be thereby moved at uniform velocity.

FIG. 8 shows a backside support structure of the chain 4 passing through the chain driving mechanism 30. A plurality of backside support rollers 35 which roll links 4*b* of the chain 4 are provided on the upper side of the trochoidal rolling gears 33, at a predetermined interval along the length direction of the chain 4. The backside support rollers 35 have a function of restricting flotage (N: see FIG. 8) of the links 4*b* which occurs when the trochoidal rolling gears 33 engage with the pin rollers 4*a* and propel the chain 4.

FIG. 9 shows a top view of the chain driving mechanism in the driving unit of another conventional conveyor apparatus. The entire structure of this conveyor apparatus is the same as that shown in FIG. 6. In the chain driving mechanism 30 of this conveyor apparatus, as shown in FIG. 9, however, a circular funicular body 36 is provided between the rocking unit 32 which executes the rocking movement by the operation of the motor 21 and the chain 4 and the rocking movement of the rocking unit 32 is converted into the circulating movement of the circular funicular body 36 to transfer the propelling force to the chain 4. The circular funicular body 36 comprises circulating rollers 36*a*, trochoid-shaped pin roller rolling internal gears 36*b*, and trochoid-shaped pin roller rolling external gears 36*c*. Rocking rollers 32*a* are provided between the rocking unit 32 and the pin roller rolling internal gears 36*b*. The rocking unit 32 is coupled to follower shafts 38. The follower shafts 38 eccentrically revolve when the eccentric shaft 31 eccentrically revolves.

In the above-described structure, a part which receives the rocking movement of the rocking unit 32 and a part which supplies the propelling force to the chain 4 are separated and independent in the chain driving mechanism 30 to attempt reducing the rocking. This technique is disclosed in, for example, Jpn. Pat. Appln. KOKAI Publication No. 2003-192263.

Incidentally, either of the above-described conveyor apparatuses must have the following functions and performance. FIG. 10 is a cross-sectional view of the conveyor apparatus, illustrating the arrangement of the driving unit 10*a*.

At the middle part of the escalator, a step 3*a*carrying a passenger moves to an upper side of the structure (i.e. a forward side of FIG. 10) while a return-side step 3*b* moves to a lower side (i.e. a backward side of FIG. 10). At this time, a gap between the forward-side step and the backward-side step is approximately 300 to 400 mm. The power unit 20 comprising the motor 21 which drives the chain driving mechanism 30, and the like need to be installed in this gasp. In addition, noise caused by the power unit 20 needs to be so small as to give no uncomfortableness to passengers and surroundings.

If a safety device of the escalator detects an accident that the passenger is sandwiched between the steps 3, a failure of the driving unit 10*a*, and the like, movement of the steps 3 needs to be certainly stopped while reducing the influence to passengers to a minimum.

Moreover, the condition of the chain 4 and the engagement of the driving unit 10*a* with the chain 4 are regularly checked from the viewpoint of ensuring safety of the escalator. The steps 3 are detached at the checking operation. It is therefore desirable that the condition of the chain 4 and the engagement of the driving unit 10*a* with the chain 4 can be checked by merely detaching the steps 3. However, even if the steps 3 are detached, it is difficult to confirm tem due to disturbance of a number of members.

Furthermore, when the trochoidal rolling gears 33 and the circular funicular body 36 in the chain driving mechanism 30 engage with the pin rollers 4*a* of the chain 4 to propel the chain 4, the steps 3 are vibrated by impulse caused between the chain 4 and the backside support rollers 35. The vibration of the steps 3 must be so small as to give no uncomfortableness to passengers.

Furthermore, production of noise needs to be restricted at an escalator of a building where silence is considered very important, such as a hotel, a hospital and the like.

BRIEF SUMMARY OF THE INVENTION

According to an aspect of the present invention, there is provided a conveyor apparatus comprises a plurality of steps that are moved along tracks, step chains which couple the plurality of steps such that the steps endlessly circulate, and driving units which drive the step chains. Each of the driving units comprises a power unit comprising a general-purpose motor provided on a structure, and a driving machine including pulleys and friction belts that reduce a rotation speed of the motor so as to meet a required reduction gear ratio and transfer the rotation speed to the step chains, and a pair of right and left driving mechanisms that convert a rotary movement transferred from the driving machine of the power unit via an eccentric shaft into a rocking movement of rocking units, and apply a propelling force to the step chains via pin rollers provided at any one of sides of the rocking units and the step chains and trochoidal rolling gears provided at the other side of the rocking units and the step chains to engage with the pin rollers.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Embodiments of the present invention will be explained below with reference to the accompanying drawings.

First Embodiment

Figure 1:
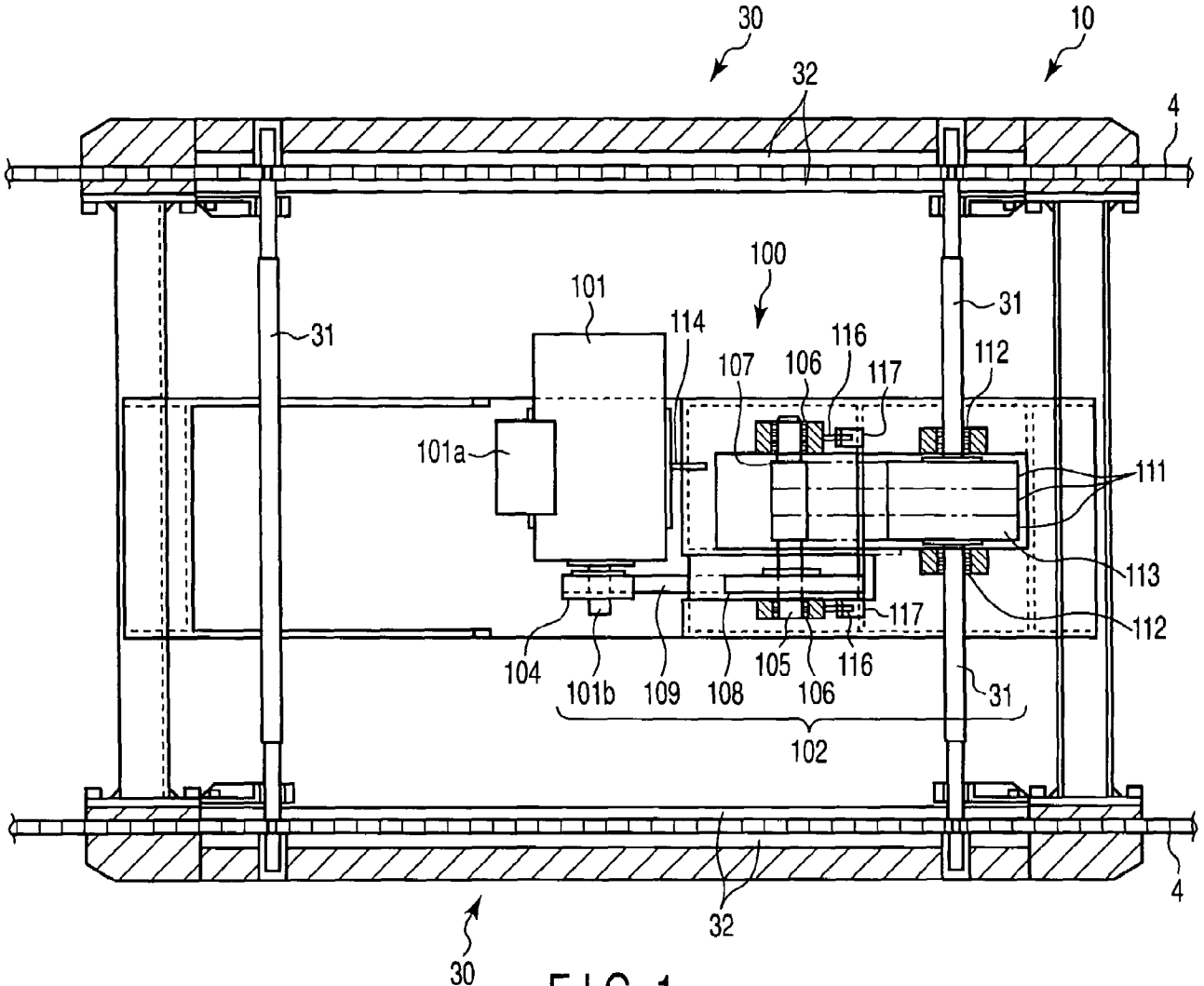
FIG. 1 is a top view showing a structure of a driving unit of a conveyor apparatus according to a first embodiment of the present invention.

FIG. 1 shows a structure of a conveyor apparatus according to a first embodiment of the present invention and, especially, shows a top view of a driving unit 10. The conveyor apparatus according to the first embodiment of the present invention is, for example, an escalator installed between upper and lower stories of a building.

The conveyor apparatus according to the first embodiment of the present invention comprises the structure 1, the tracks 2, a plurality of steps 3, the chains 4, and the pin rollers 4*a*.

Figure 6:
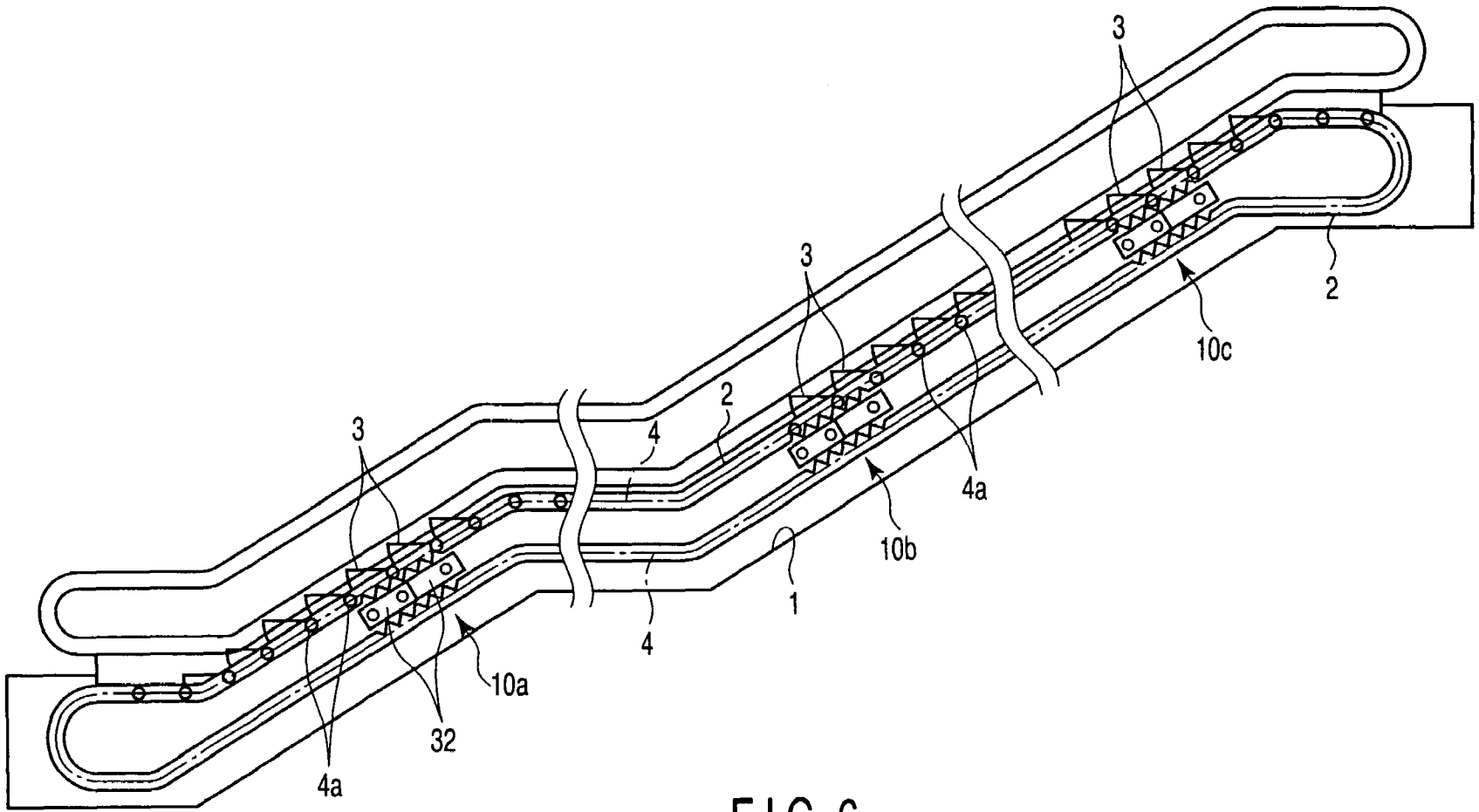
FIG. 6 PRIOR ART
FIG. 6 is an illustration showing a schematic structure of a conventional conveyor apparatus.

Since the structure 1, the tracks 2, a plurality of steps 3, the chains 4, and the pin rollers 4*a* are shown in FIG. 6, these are not shown in the other figures.

The installation part of the driving unit 10 shown in FIG. 1 is the same as the installation part of the driving units 10*a*, 10*b* and 10*c* shown in FIG. 6.

However, it differs from the composition of the driving unit 10 shown in the composition and FIG. 1 of the driving units 10*a*, 10*b* and 10*c* shown in FIG. 6.

In the conveyor apparatus, the structure 1 called truss which supports the load of the entire escalator and load of passengers is provided. A pair of right and left tracks 2 are provided inside the structure 1 to circulate through upper and lower stories of the building.

Pin rollers 4*a* which are attached to endlessly coupled chains 4 at regular intervals so as to be freely rotatable are engaged with the tracks 2. A plurality of steps 3 that carry passengers are coupled to the pin rollers 4*a* to circulate endlessly. In other words, a plurality of steps 3 are endlessly coupled by the chains 4 having the pin rollers 4*a*.

A plurality of steps 3 are formed to circulate through upper and lower stories of the building along the tracks 2. In addition, for example, three driving units 10*a*, 10*b* and 10*c* having rocking units which supply the propelling force to the chains 4 are dispersed in the conveyor apparatus.

Since the driving units 10*a*, 10*b* and 10*c* have the same structure, one of the driving units is explained with reference numeral 10.

The driving unit 10 comprises a power unit 100 and a pair of right and left chain driving mechanisms 30. The power unit 100 generates power to drive the chains 4. The chain driving mechanisms 30 are arranged in pairs at right and left sides to sandwich the power unit 100.

The chain drive mechanism 30 of the conveyor apparatus according to a first embodiment of the present invention comprises the eccentric shaft 31, the rocking units 32, the trochoidal rolling gears 33, and the backside guide plates 34.

Figure 7:
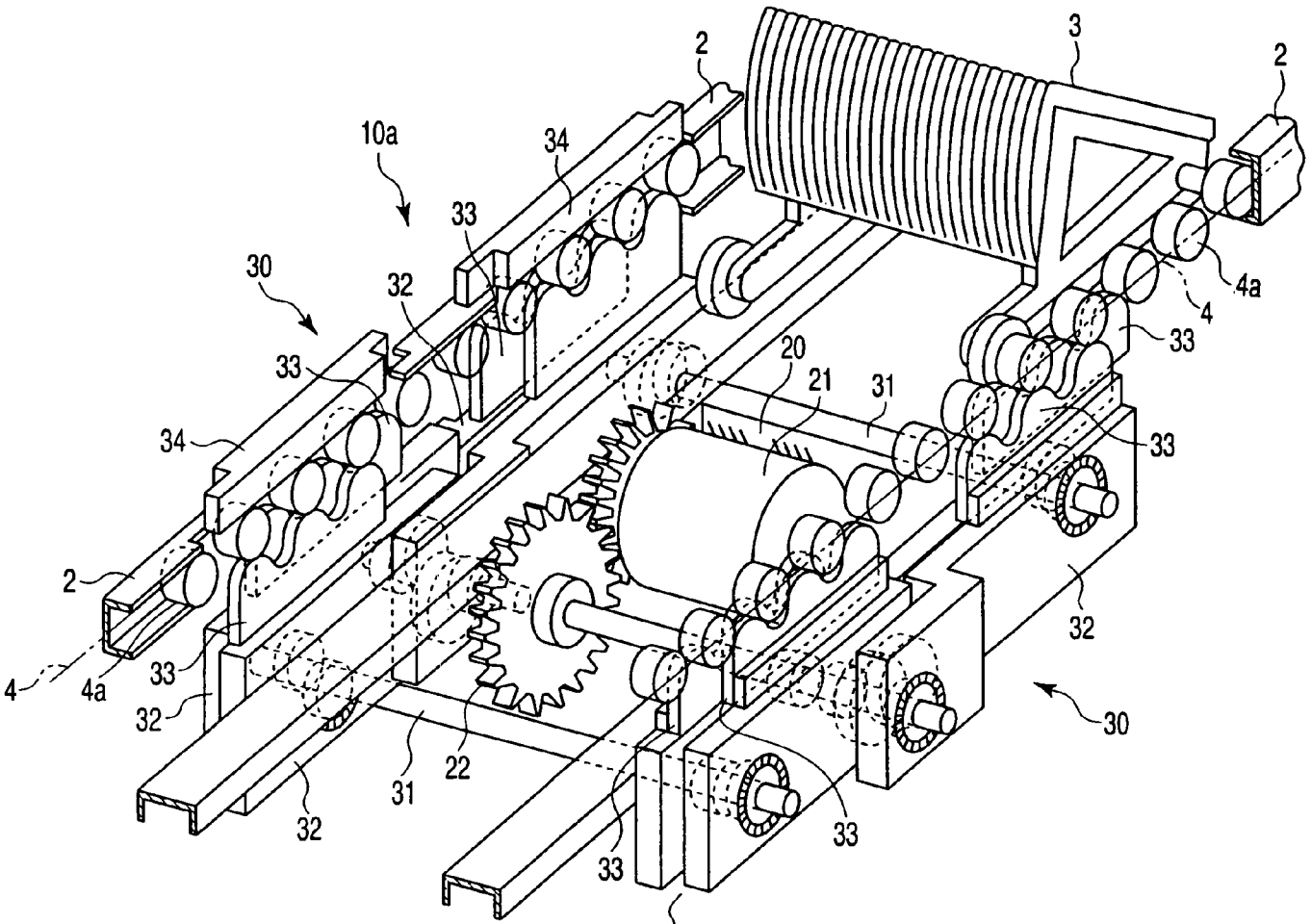
FIG. 7 PRIOR ART
FIG. 7 is an illustration showing a structure of a driving unit of the conventional conveyor apparatus.

Since the eccentric shaft 31, the rocking units 32, the trochoidal rolling gears 33, and the backside guide plates 34 are shown in FIG. 7, these are not shown in the other figures.

The eccentric shaft 31 inputs rotation of the power unit 100. The rocking units 32 convert the rotation of the eccentric shaft 31 into rocking movement. The trochoidal rolling gears engage with the pin rollers 4*a* which are attached to the chains 4 at regular intervals so as to be freely rotatable and supply the rocking movement of the rocking units 32 to the chains 4 as the propelling force. The pin rollers 4*a* may be attached to the chains 4 at regular intervals or attached to the rocking units 32.

On the other hand, the power unit 100 is attached to the structure 1. The power unit 100 comprises a motor 101 having a terminal box 101*a* and a driving mechanism 102. The terminal box 101*a* is used as a driving source of the chain driving mechanisms 30.

The driving mechanism 102 reduces the rotary speed of the motor 101 to a desired speed. The power unit 100 is constituted such that the rotary force reduced by the driving mechanism 102 is transferred to the eccentric shaft 31 of the chain driving mechanisms 30.

The rotation transferring system to transfer the rotary force of the motor 101 to the eccentric shaft 31 specifically has the following structure. In the rotation transferring system, a rotary output shaft 101*b* is taken from a one-side direction of the motor 101 (lower-side direction of the figure) to the outside. A pulley 104 is attached to the rotary output shaft 101*b*. A middle shaft 105 is arranged between the motor 101 and the eccentric shaft 31.

Both end portions of the middle shaft 105 are supported by bearings 106, 106 such that the middle shaft 105 can be rotated. A plurality of pulleys 107 having a small diameter and a great width are attached to a middle portion of the middle shaft 105. Furthermore, a pulley 108 having a larger diameter is attached to a one-end side corresponding to a part between the pulleys 107 and one of the bearings 106 located on the lower side of the figure.

In the rotation transfer system, a friction belt 109 shaped in an endless band is looped over the pulley 104 attached to the rotary output shaft 101*b* of the motor 101 and the larger-diameter pulley 108 attached to the middle shaft 105.

Moreover, a plurality of pulleys 111 having a large diameter and a great width are attached to predetermined parts of the eccentric shaft 31, at positions corresponding to the respective pulleys 107 attached to the middle shaft 105. Side parts of the eccentric shaft 31 comparatively close to the pulleys 111 are supported by bearings 112, 112 so as to be freely rotatable.

A friction belt 113 shaped in an endless band is looped over the pulleys 107 attached to the middle shaft 105 and the large-diameter wide pulleys 111 attached to the eccentric shaft 31.

Figure 2:
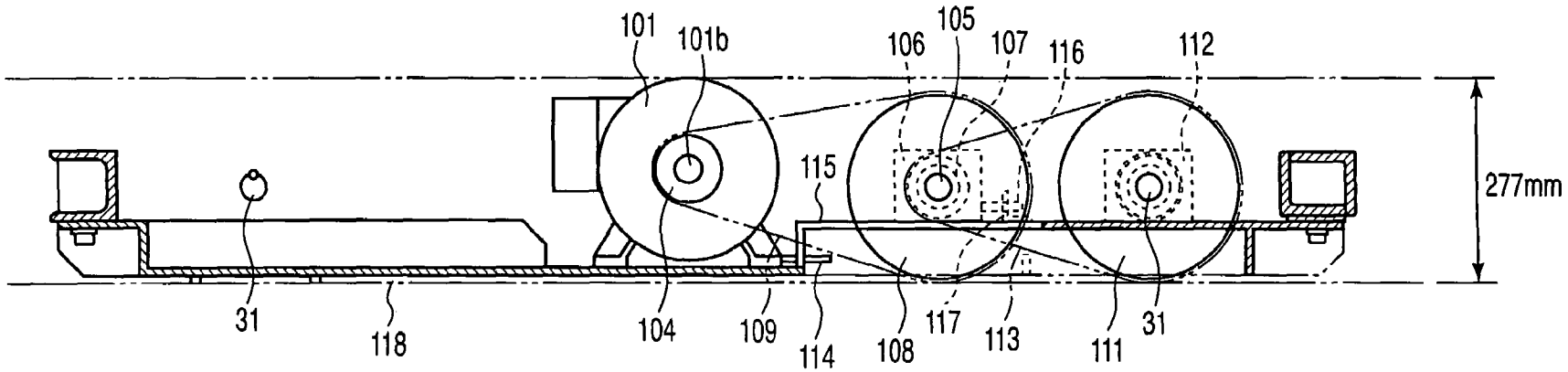
FIG. 2 is an illustration showing height of a power unit serving as one of constituent elements of the driving unit of the conveyor apparatus according to the first embodiment of the present invention.

FIG. 2 illustrates the height of the power unit 100 of the driving unit 10 in the conveyor apparatus shown in FIG. 1.

As shown in FIG. 1 and FIG. 2, the power unit 100 comprises a tensioner 114, a support table 115, tensioners 116, L members 117 and a fixing member 118.

The tensioner 114 is fitted in a one-side frame of the support table 115 which supports the bearings 106 and 112 so as to freely move back and forth, as shown in FIG. 2, such that a fixation table of the motor 101 can be moved and a proper tension can be applied to the friction belt 109. The tensioners 116 are fitted in the L members 117, 117 which are fixed respectively on the support table 115, such that one-side surfaces of the bearings 106, 106 of the middle shaft 105 can be moved and a proper tension can be applied to the friction belt 113. The fixing member 118 fixes the motor 101.

Next, an operation of the driving unit 10 provided in the above-described conveyor apparatus will be explained. First, a proper tension is set to be applied to the friction belts 109 and 113 by the tensioners 114 and 116, the motor 101 is fixed on the fixing member 118 and the bearings 106, 106 of the middle shaft 105 are positioned on the support table 115. After necessary adjustment is thus completed, the conveyor apparatus becomes operable.

In this state, when the motor 101 is driven, the output shaft 10*b* of the motor 101 is rotated. The rotation of the output shaft 101*b* is transferred from the pulley 104 to the middle shaft 105 via the friction belt 109 and the large-diameter pulley 108.

When the middle shaft 105 is rotated, the rotation of middle shaft 105 is transferred to the eccentric shaft 31 via the friction belt 113 (FIG. 2) looped over a plurality of small-diameter and wide pulleys 107 which are attached to the middle shaft 105 and a plurality of large-diameter and wide pulleys 111. As a result, every time the eccentric shaft 31 is rotated at one time, chain 4 proceeds by one pitch.

Incidentally, an example of driving an escalator installed in a standard building having a height of story of 3.5 m by the driving unit 10 alone will be now reviewed. The driving unit 10 needs to comprise the motor 101 and the driving mechanism 102 as the power unit 100, by considering that the power unit 100 is installed inside the gap of 300 to 400 mm between the forward-side step and the backward-side step.

It is assumed that the motor 101 is selected from commercially available general-purpose induction motors. For example, a bipolar induction motor of 5.5 KW is applicable as the selected motor 101. The number of revolution of the motor is 1500 per minute in the area where the commercial power frequency is 50 Hz or 1800 per minute in the area where the commercial power frequency is 60 Hz.

The driving mechanism 102 may be changed in accordance with a required reduction gear ratio. As the reduction gear ratio is smaller, the driving mechanism 102 becomes larger and the conveyor apparatus can hardly be contained in a small space. If the pitch of the standard chain 4 is 133.33 mm, the number of revolution of the motor 101 is 1800 per minute and the moving speed of the steps is 30 m per minute, the reduction gear ratio 1/n can be represented by following equation (1):

$$1/n=30000/133.33/1800=1/8 \qquad \text{Equation (1)}$$

In other words, if each of the effective diameter of the pulley 104 attached to the output shaft 101*b* of the motor 101 and the effective diameter of the small-diameter and wide pulleys 107 attached to the middle shaft 105 is 88 mm and if each of the effective diameter of the large-diameter pulley 108 attached to the middle shaft 105 and the effective diameter of the large-diameter and wide pulleys 111 attached to the eccentric shaft 31 is 250 mm, the desired reduction gear ratio 1/8, to be reduced by the driving mechanism 102 can be achieved.

The desired reduction gear ratio is 1/8 when a commercially available general-purpose product, for example, a bipolar induction motor of 5.5 KW is used as the selected motor 101, the cheap standard chain 4 having a pitch of 133.33 mm is used, the number of revolution of the motor is set at 1800 per minute and the moving speed of the steps 3 is set at 30 m per minute. The reduction gear ratio of 1/8 can easily be achieved if the pulley 104 attached to the output shaft 101*b* and the small-diameter and wide pulleys 107 attached to the middle shaft 105 are designed to have the effective diameter of 88 mm and if the large-diameter pulley 108 attached to the middle shaft 105 and the large-diameter and wide pulleys 111 attached to the eccentric shaft 31 are designed to have the effective diameter of 250 mm.

As a result, the height of the power unit 100 including the fixing member 118 which fixes the motor 101 can be set at 277 mm. Thus, the conveyor apparatus can be certainly contained in the gap of 300 to 400 mm between the forward-side step and the backward-side step.

According to the above-described embodiment, the gap between the forward-side step and the backward-side step is small, i.e. approximately 300 to 400 mm. By using the general-purpose motor 101 and the cheap and standard chain 4 and by providing the pulleys 104, 108, 107, 111 and the friction belts 109, 113 between the motor 101 and the eccentric shaft 31 which propels the chain 4, the conveyor apparatus can easily be contained in the small gap of approximately 300 to 400 mm between the steps.

If a trouble that the conveyor user may be involved in the steps 3 occurs for some reason, overload is applied to the driving machine 102, either or both of the friction belts 109, 113 are slipped and the movement of the steps 3 is thereby stopped. Influence to the conveyor user can be therefore limited to a minimum.

Second Embodiment

Figure 3:
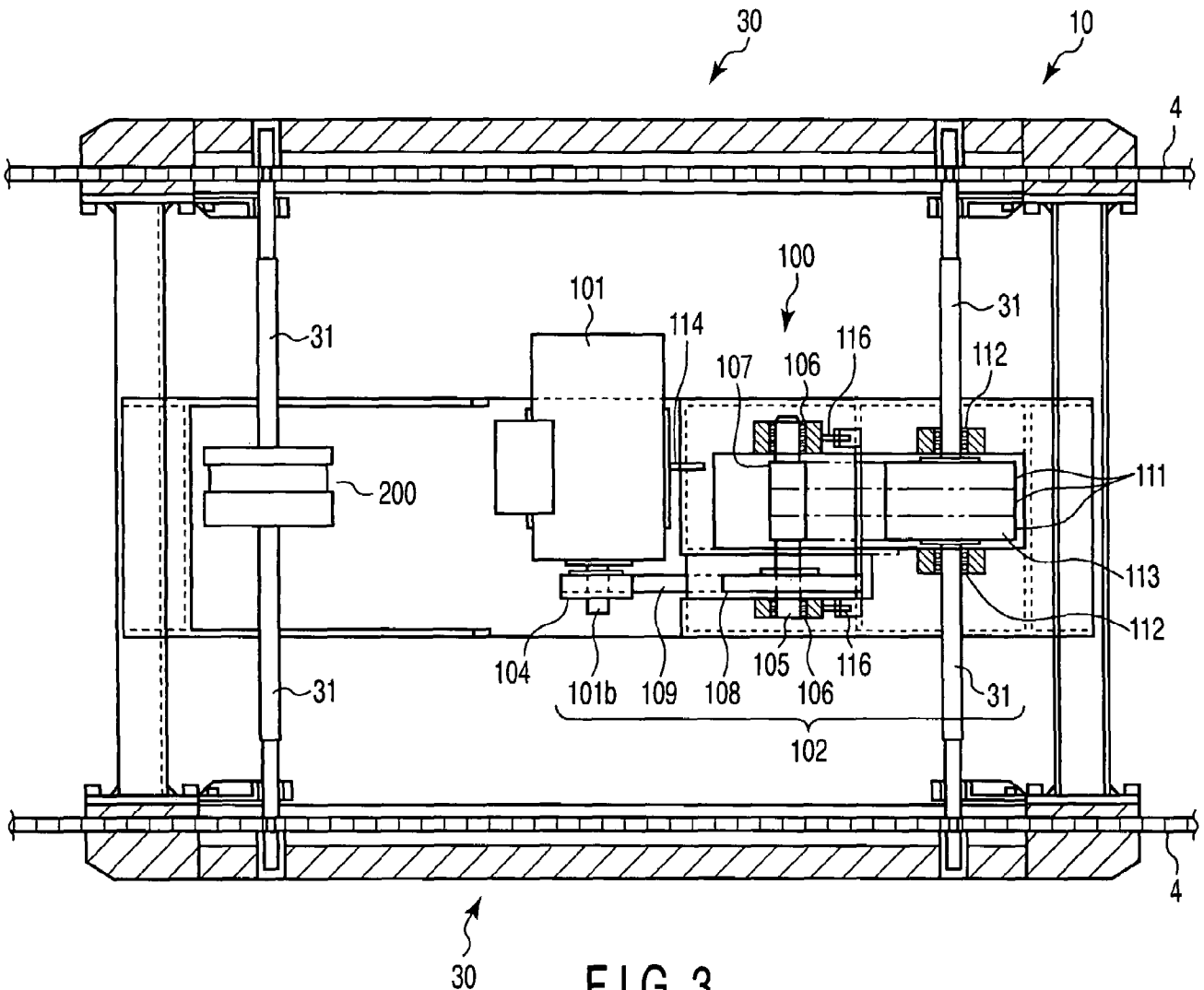
FIG. 3 is a top view showing a structure of a driving unit of a conveyor apparatus according to a second embodiment of the present invention.

FIG. 3 is a top view showing a structure of the driving unit 10 of a conveyor apparatus according to a second embodiment of the present invention. In FIG. 2, elements like or similar to those shown in FIG. 1 are denoted by similar reference numbers and have been described with reference to FIG. 1. Different portions from FIG. 1 will be explained below.

In the driving unit 10 (FIG. 1) of the conveyor apparatus according to the first embodiment, the eccentric shaft 31 which transfers the rotary speed of the motor 101 to the rocking unit 32 at the desired reduction gear ratio is provided. In the conveyor apparatus according to the second embodiment, however, another eccentric shaft 31 is provided besides the eccentric shaft 31.

In other words, for example, the motor 101 is provided at a substantially middle position of the conveyor apparatus according to the second embodiment, and two eccentric shafts 31, 31 are arranged at front and rear sides, respectively, at a required distance from the motor 101. One of the eccentric shafts 31, 31 is connected to the output shaft of the motor 101 via the driving mechanism 102 as explained above while a brake unit 200 is attached to the other eccentric shaft 31.

Various kinds of brakes including an electromagnetic brake are used as the brake unit 200. The brake unit has a function of remaining opened at any time when the conveyor apparatus is operated under a normal condition, but forming a coupled state and stopping the movement of the steps 3 via the rocking unit 32 when a safety device provided at the escalator to detect various kinds of abnormal conditions is operated. The other constituent elements are the same as those of FIG. 1 and have been described with reference to FIG. 1.

Therefore, when the above-described conveyor apparatus is operated by the rotation of the motor 101 provided in the conveyor apparatus, under the normal condition, the brake unit 200 is always opened.

However, if a safety device (not shown) detects an accident that the user of the conveyor apparatus is included in the steps, a breakage of the driving unit 10, and the like, the brake unit 200 is operated on the basis of the detection of the abnormal condition executed by the safety device. When the brake unit 200 is operated, the movement of the rocking unit 32 comprising the trochoidal rolling gear 33 making the rocking movement by the rotation of the eccentric shaft 31 to which the brake unit 200 is attached is stopped. The movement of the steps 3 (not shown) coupled to the chains 4 so as to circulate endlessly is stopped.

According to the conveyor apparatus according to the second embodiment, the brake unit 200 is attached to the eccentric shaft 31 not via the power unit 100, but directly. Therefore, when the safety device detects an abnormal condition, free running caused by slipping of the friction belts 109 and 113 does not occur. Even if the power unit 100 is a broken state, the movement of the steps 3 can be certainly stopped by the brake unit 200, on the basis of the detection of the abnormal condition executed by the safety device.

Third Embodiment

Figure 4:
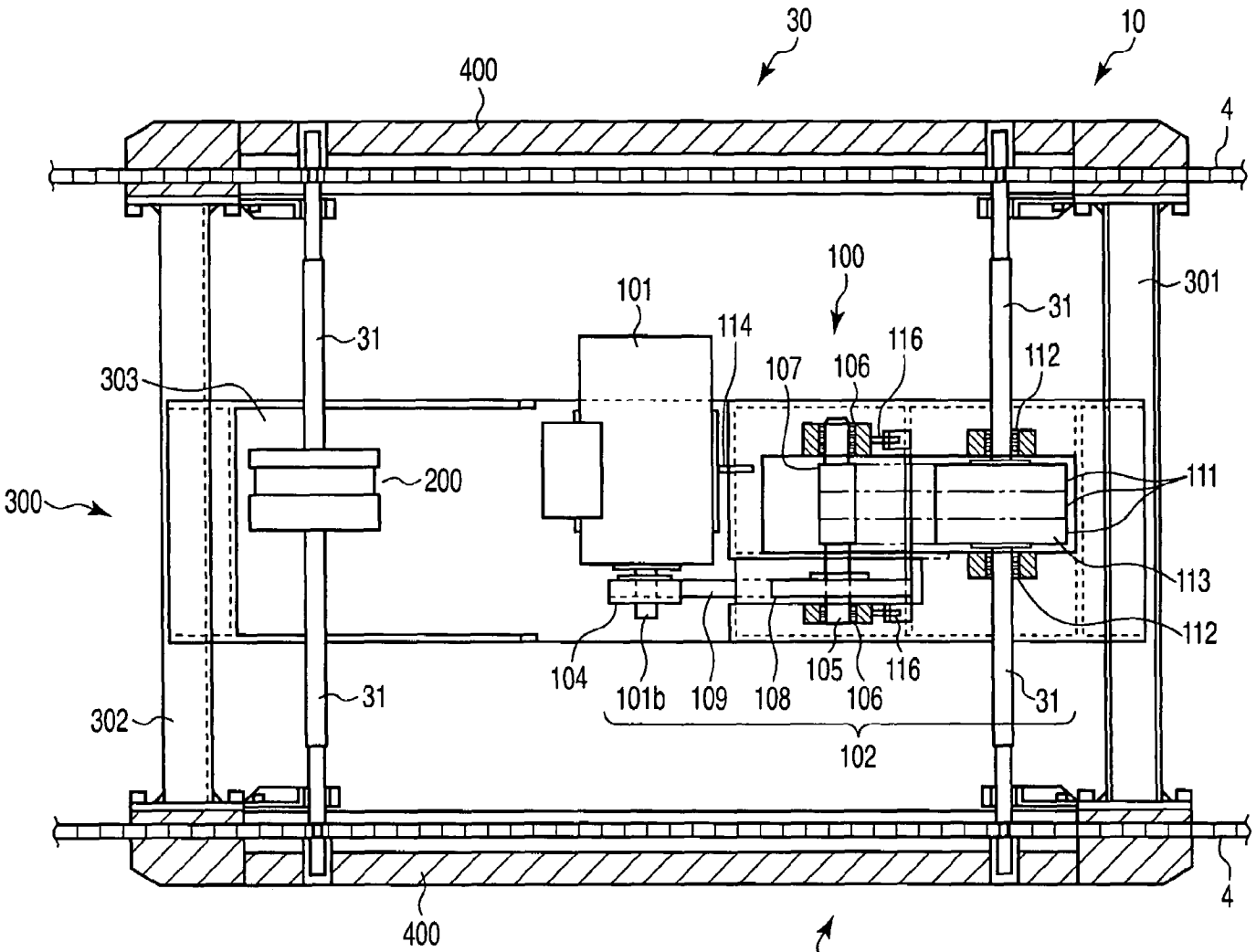
FIG. 4 is a top view showing a structure of a driving unit of a conveyor apparatus according to a third embodiment of the present invention.

FIG. 4 is a top view showing a structure of the driving unit 10 of a conveyor apparatus according to a third embodiment of the present invention. Elements like or similar to those shown in FIG. 1 and FIG. 3 are denoted by similar reference numbers in FIG. 4 and have been described with reference to FIG. 1 and FIG. 3. Different portions from FIG. 1 and FIG. 3 will be explained below.

In the conveyor apparatus according to the third embodiment, the power unit 100 is provided in the driving unit 10, similarly to the first and second embodiments. However, the power unit 100 is supported by a supporting structure 300 which forms a spatial portion except for the exclusive portion of the power unit 100 arranged between a pair of right and left driving mechanisms 30, 30. Thus, when the conveyor is checked, necessary constituent elements including the chain 4 can easily be confirmed by detaching the steps 3.

The supporting structure 300 includes two arms 301, 302, and a support base 303. The arms 301 and 302 are coupled respectively to a front side and a rear side of a pair of right and left frames 400 that support the pair of right and left driving mechanisms 30, 30, so as to spread between the right and left frames 400.

The support base 303 is attached to the arms 301 and 302 so as to spread therebetween. The portion at which the power unit 100 is installed alone is substantially regarded as the support base and the other portion is the spatial portion. In other words, the support base 303 corresponds to the fixing member 118 and the support table 115 shown in FIG. 1 and FIG. 2. The support base 303 has a function of fixing and supporting the bearings 106 which rotatably support the middle shaft 105 provided in the driving mechanism 102, the bearings 112 which support the eccentric shaft 31, and the like.

In the above-explained structure, two eccentric shafts 31, 31 alone cross the spatial portion between the support base 303 and the right and left driving mechanisms 30 as clarified in FIG. 4, and the other portions can be seen from the top. Thus, if the steps 3 are detached, the condition of the chain 4, the engagement between the trochoidal rolling gear 33 and the chain 4 in the driving mechanism 30, and the like can easily be confirmed at the forward side and the backward side, efficiency of the checking operation can be improved and accuracy of the checking operation can be expected.

Fourth Embodiment

A conveyor apparatus according to a fourth embodiment of the present invention will be described.

The chain drive mechanism 30 of the conveyor apparatus according to a fourth embodiment of the present invention comprises a plurality of backside support rollers 35.

Moreover, the chains 4 comprise links 4*b*.

Figure 8:
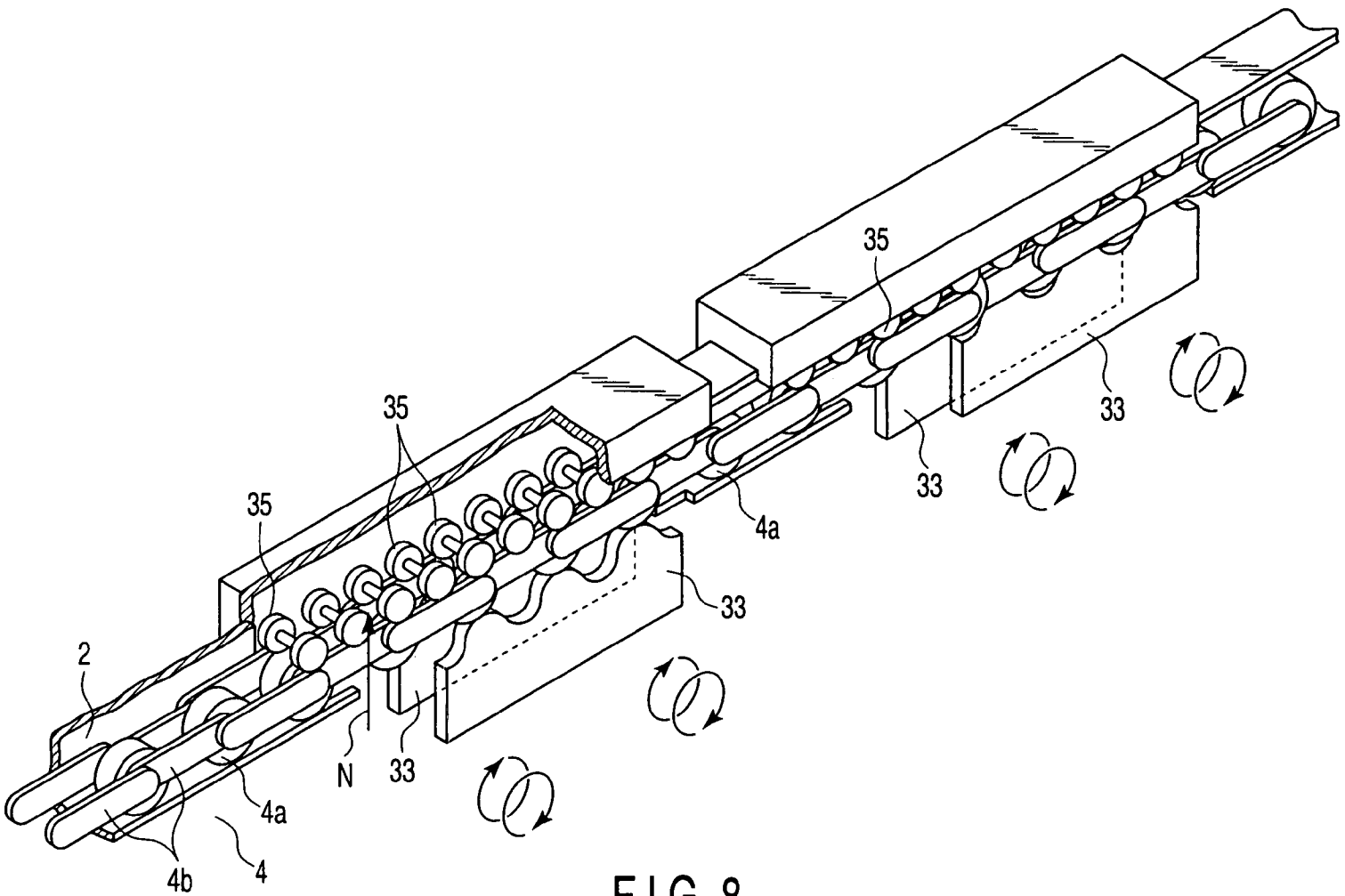
FIG. 8 PRIOR ART
FIG. 8 is an illustration showing a supporting portion of a chain backside surface in the conventional conveyor apparatus.
Figure 9:
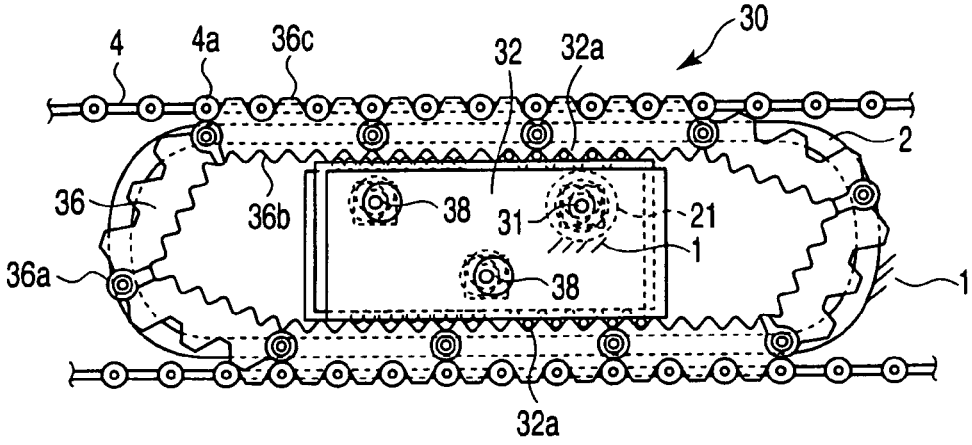
FIG. 9 PRIOR ART
FIG. 9 is a top view showing a chain driving mechanism in a driving unit of another conventional conveyor apparatus.
Figure 10:
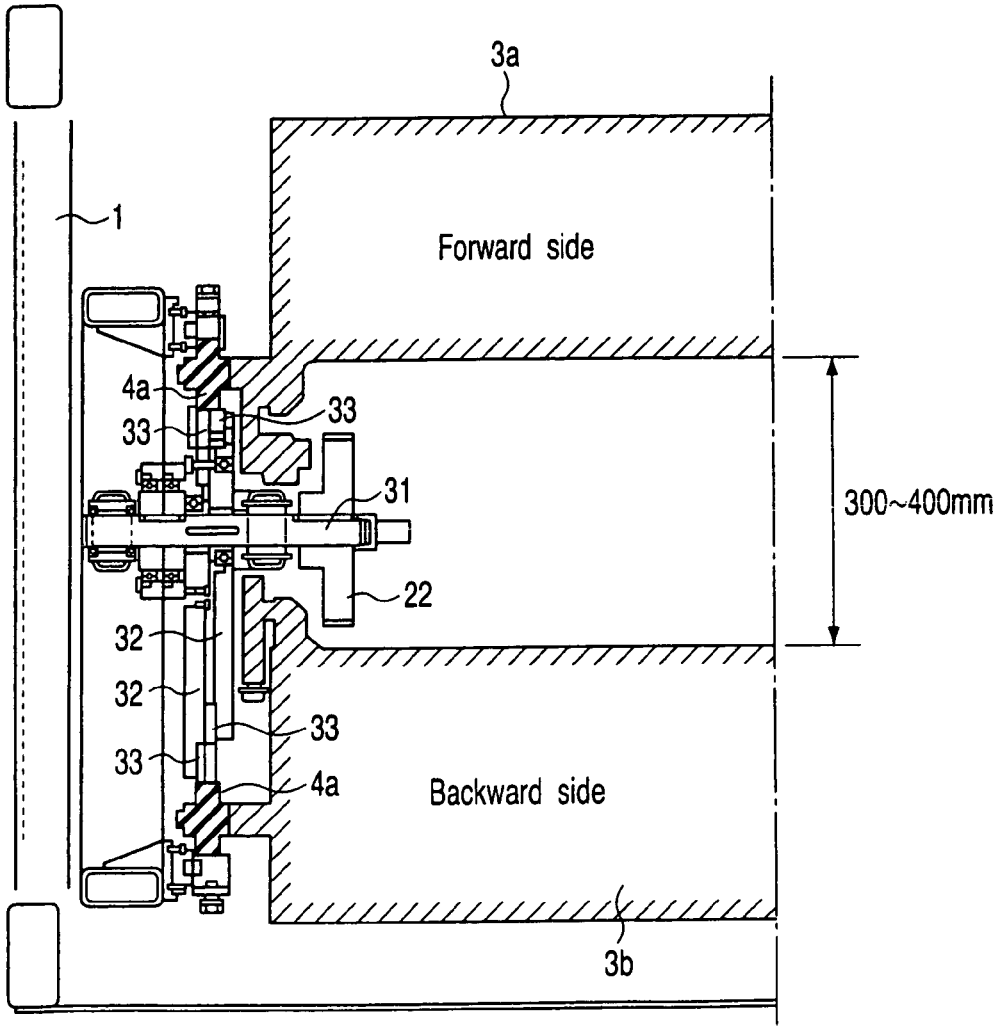
FIG. 10 PRIOR ART
FIG. 10 is an illustration showing a relationship between a gap of the upper and lower steps and the driving unit, in the conventional conveyor apparatus.

Since links 4*b* and a plurality of backside support rollers 35 are shown in FIG. 8, these are not shown in the other figures.

In the conveyor apparatus according to the fourth embodiment, a plurality of backside support rollers 35 are provided above the trochoidal rolling gears 33 to sandwich the chain 4 therewith. The function of the backside support rollers 35 to absorb the impulse can be enhanced by forming the backside support rollers 35 of a resin material such as MC nylon.

The backside support rollers 35 are arranged at regular intervals in the length direction of the chain 4. The backside support rollers 35 have a function of rolling links 4*b* of the chain 4 to restrict the flotage of the links 4*b* which occurs when the trochoidal rolling gears 33 propel the chain 4.

Thus, according to the above-described fourth embodiment of the present invention, the backside support rollers 35 have a function of absorbing impulse and vibration since they are formed of a resin material. The impulse generated between the chain 4 and the backside support rollers 35 can be absorbed by the backside support rollers 35 when the trochoidal rolling gears 33 of the rocking units 32 engage with the pin rollers 4*a* of the chain 4 and propel the chain 4. Therefore, vibration of the steps 3 can be reduced and a silent conveyor apparatus can be implemented.

Fifth Embodiment

Figure 5:
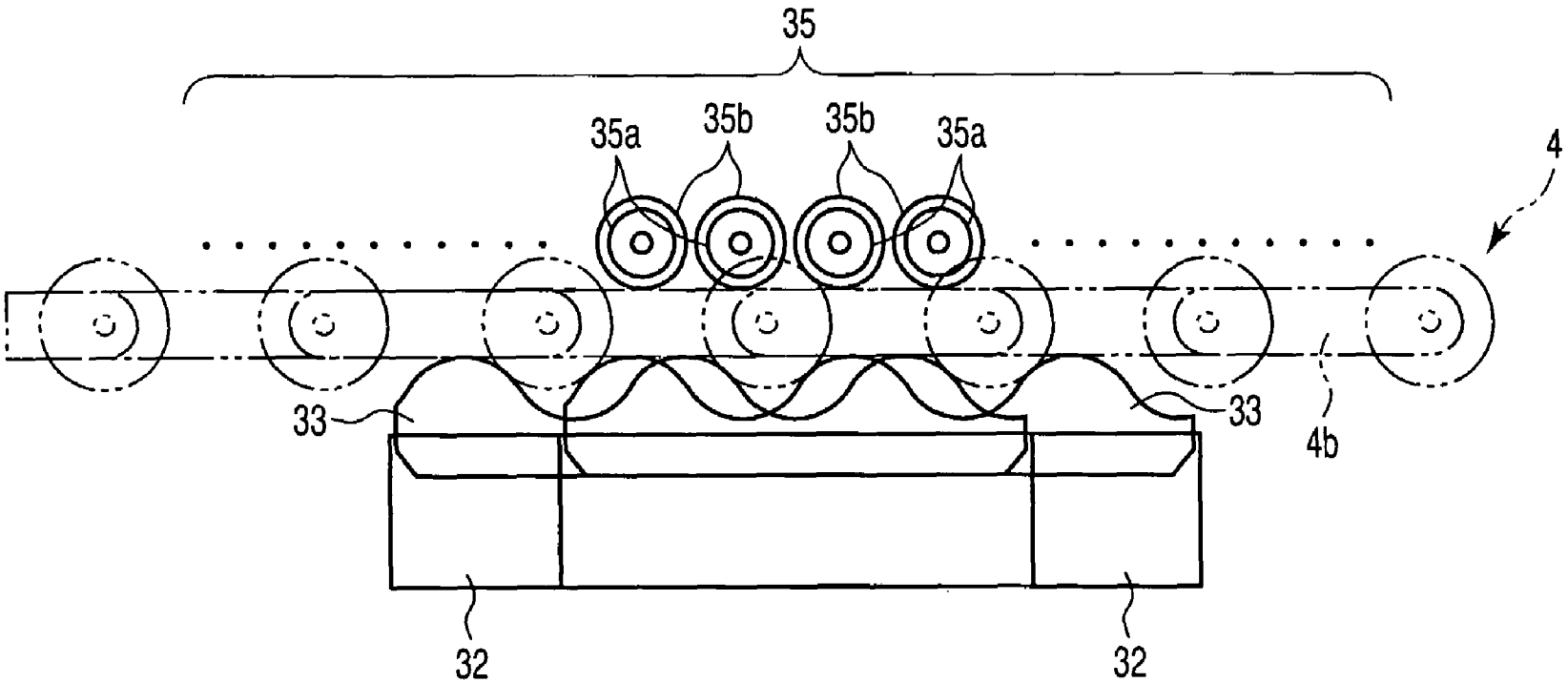
FIG. 5 is an illustration showing surroundings of a chain of a conveyor apparatus according to a fifth embodiment of the present invention.

FIG. 5 is an illustration showing surroundings of the chain 4 passing through the chain driving mechanism 30 of a conveyor apparatus according to a fifth embodiment of the present invention.

In the conveyor apparatus according to the fifth embodiment, a plurality of backside support rollers 35 are provided above the trochoidal rolling gears 33 at regular intervals in the length direction of the chain 4 to sandwich the chain 4 therewith.

The backside support rollers 35 have a function of rolling the links 4*b* of the chain 4 to restrict the flotage of the links 4*b* which occurs when the trochoidal rolling gears 33 propel the chain 4.

Each of the backside support rollers 35 comprises an inner body 35*a* and an outermost peripheral body 35*b*. The outermost peripheral body 35*b* covers the inner body 35*a* in a required thickness. The inner body 35*a* is formed of a comparatively flexible material such as rubber. The outermost peripheral body 35*b* is a comparatively thin layer formed of a hard material such as metal.

According to the present embodiment, since the outermost peripheral bodies 35*b* of the backside support rollers 35 are formed of a hard material, they keep the surface-pressure intensity to the impulse which is generated between the chain 4 and the backside support rollers 35 when the trochoidal rolling gears 33 of the rocking units 32 engage with the pin rollers 4*a* of the chain 4 and propel the chain 4. On the other hand, since inner bodies 35*a* are formed of a flexible material and absorb the impulse, they can reduce the vibration of the steps 3, similarly to the fourth embodiment. Therefore, a silent conveyor apparatus can be implemented.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A conveyor apparatus comprising:

a plurality of steps that are moved along tracks;

step chains which couple the plurality of steps such that the steps endlessly circulate; and driving units which drive the step chains, each of the driving units comprising:

a power unit comprising a general-purpose motor provided on a structure, and a driving machine including pulleys arranged in series along a movement direction of the steps and friction belts that reduce a rotation speed of the motor so as to meet a required reduction gear ratio and transfer the rotation speed to the step chains;

a pair of right and left driving mechanisms that convert a rotary movement transferred from the driving machine of the power unit via an eccentric shaft into a rocking movement of rocking units, and apply a propelling force to the step chains via pin rollers provided at any one of sides of the rocking units and the step chains and trochoidal rolling gears provided at the other side of the rocking units and the step chains to engage with the pin rollers;

two arms provided at front and rear portions of right and left frames that support required members of the pair of right and left driving mechanisms, and having a spatial portion required to arrange the power unit inside the arms; and a device support base attached to the arms as a bridge, and having a portion shared by the power unit as the support base, wherein besides the first eccentric shaft to which a rotational movement is transferred from the motor via the driving mechanism, a second eccentric shaft to which the rotational movement is not transferred is arranged in an opposite direction such that the motor is sandwiched between the eccentric shafts;

a brake unit which is opened at a normal time but is operated in accordance with detection of an abnormal condition executed by a safety device is provided on the second eccentric shaft; and when the brake unit is operated, the movement of the steps is stopped via the rocking units.

2. The conveyor apparatus according to claim 1, wherein backside support rollers provided at an opposite side to the trochoidal rolling gears so as to sandwich the step chain with the trochoidal rolling gears, to restrict flotage of links which occurs when the trochoidal rolling gears propel the step chain, are formed of a resin material.

3. The conveyor apparatus according to claim 1, wherein each of backside support rollers provided at an opposite side to the trochoidal rolling gears so as to sandwich the step chain with the trochoidal rolling gears, to restrict flotage of links which occurs when the trochoidal rolling gears propel the step chain, has an inner body and an outermost peripheral body which covers an outer side of the inner body in a required thickness; and the inner body is formed of a flexible material and the outermost peripheral body is formed of a hard material.

* * * * *